US007694826B2

(12) United States Patent
Garrett et al.

(10) Patent No.: US 7,694,826 B2
(45) Date of Patent: Apr. 13, 2010

(54) SIEVING APPARATUS

(75) Inventors: David Aubrey Garrett, Surrey (GB); Miriam Meei Yunn Chong, Hampshire (GB); Nigel John Mainwaring, Surrey (GB)

(73) Assignee: Russell Finex Limited, Middlesex (GB)

( * ) Notice: Subject to any disclaimer, the term of this patent is extended or adjusted under 35 U.S.C. 154(b) by 0 days.

(21) Appl. No.: 12/364,683

(22) Filed: Feb. 3, 2009

(65) Prior Publication Data

US 2009/0194467 A1 Aug. 6, 2009

Related U.S. Application Data

(63) Continuation of application No. 10/536,960, filed as application No. PCT/GB03/05233 on Dec. 1, 2003, now Pat. No. 7,497,338.

(30) Foreign Application Priority Data

Dec. 2, 2002 (GB) ..... 0228085.7

(51) Int. Cl.
*B07B 1/50* (2006.01)

(52) U.S. Cl. ..... 209/381; 209/365.1

(58) Field of Classification Search ..... 209/364, 209/365.1, 365.3, 381, 382, 383
See application file for complete search history.

(56) References Cited

U.S. PATENT DOCUMENTS

| | | | | |
|---|---|---|---|---|
| 4,836,385 | A | 6/1989 | Siesarenko et al. | 209/315 |
| 5,213,216 | A | 5/1993 | Suehiro et al. | 209/236 |
| 5,653,346 | A | 8/1997 | Frei et al. | 209/254 |
| 5,799,799 | A | 9/1998 | Alamzad et al. | 209/365.1 |
| 6,079,569 | A | 6/2000 | Monteith | 209/365.1 |
| 6,845,868 | B1 | 1/2005 | Krush et al. | 209/365.4 |
| 7,182,206 | B2 | 2/2007 | Hukki et al. | 209/365.1 |

FOREIGN PATENT DOCUMENTS

| | | |
|---|---|---|
| DE | 1 193 346 | 5/1965 |
| EP | 0 652 810 B2 | 7/2002 |
| GB | 2 343 392 A | 5/2000 |
| JP | 2002205015 A | 7/2002 |
| SU | 570 414 A | 8/1977 |
| SU | 757 212 A | 8/1980 |
| WO | WO 99/16558 | 4/1999 |

OTHER PUBLICATIONS

Search Report from Great Britain Patent Office regarding Application No. GB 0228085.7.

*Primary Examiner*—Patrick H Mackey
*Assistant Examiner*—Mark Hageman
(74) *Attorney, Agent, or Firm*—Westman, Champlin & Kelly, P.A.

(57) ABSTRACT

An industrial sieving or screening machine has a resonator rod on the separator screen. The rod extends between two spaced ends and has a transducer located at one end to excite the rod over its length to assist with deblinding the screen. The rod may be spiral in shape or shaped with other smoothly blended complex curves such as an S-shape. A spiral rod resonator fixed to the top of the sieve screen may be used as a guide for material to be screened.

11 Claims, 16 Drawing Sheets

SIEVING APPARATUS

CROSS-REFERENCE TO RELATED APPLICATION

This application is a Continuation of application Ser. No. 10/536,960, filed May 31, 2005 which is a Section 371 National Stage Application of International Application No. PCT/GB2003/005233, filed Dec. 1, 2003 and published as WO 2004/050263 on Jun. 17, 2004, in English, the contents of which are hereby incorporated by reference in their entirety.

FIELD OF THE INVENTION

The present invention relates to sieves both for dry particulate solids and for liquids and particularly sieves in which an excitation source provides deblinding excitation of the sieve screen.

BACKGROUND OF THE INVENTION

Most industrial sieving machines include some means of applying a primary vibratory movement to the sieving screen in order to facilitate product movement through the screen and also to create a flow of material over the screen surface. This ensures maximum utilisation of the active screening area and that oversized product can be transported to an outlet to be removed. The primary vibratory movement is often a combination of horizontal and vertical reciprocating motion which may typically be applied to the frame carrying the sieve mesh or screen in a variety of ways, such as by rotating out-of-balance weights, or a direct drive by a rigid crank or cam system.

A problem with sieving machines is blinding of the screen, particularly when sieving damp or sticky materials. Blinding is a significant problem in the industrial sieving of certain powders and also in the straining of liquids. To overcome the blinding problem secondary vibrations, preferably flexural, have been applied to the screen, for example by impacts from deblinding discs or the application of high and ultrasonic frequencies (see for example EP-A-0369572).

Typical ultrasonic frequencies are above 20 kHz, and typical amplitudes of the ultrasonic vibration supplied to the mesh are a few (1-10) microns. However, ultrasonic energy is quickly dissipated in the screen, making it difficult to excite a large screen area ultrasonically. Extended resonators to increase the distribution of ultrasonic energy over the screen are disclosed in EP 0652810. However, for large sieve areas, multiple transducers are still normally required.

It is also known to use guide members located above the screen to improve the flow of material to be sieved over the surface of the screen. For example, scroll-shaped guide members are used with circular sieves to ensure material to be sieved moves progressively from the centre of the screen, where it is first delivered, outwards in a generally spiral path, covering nearly all regions of the screen surface before reaching the outlet for oversize particles at or near the screen periphery. This increases the residence time over the screen, to maximise the opportunity for fines to pass through the screen. Other guide member shapes and arrangements are used for different sieve designs, in each case to improve material flow over the screen to increase the time for undersize to separate from oversize.

SUMMARY OF THE INVENTION

According to a first aspect of the present invention there is provided a sieve comprising: a base, a sieve screen frame mounted on the base, a sieve screen mounted in the frame, a vibrator arranged to vibrate the frame relative to the base, a guide member above the sieve screen for controlling flow of material to be sieved over the sieve screen; and an excitation source arranged to vibrate the guide member so as to induce a deblinding excitation of the sieve screen.

The guide member typically comprises a bar-like member secured to the top surface of the sieve screen, and shaped to control the flow of material over the sieve screen as desired. Such an arrangement provides the advantage that the sieve screen can be excited over an extended area to provide a deblinding effect, whilst at the same time controlling the flow of material over the screen surface. Generally, the level of deblinding excitation of the sieve screen decreases with increasing distance from the source of the excitation. In the above described aspect of the invention, the highest level of excitation is near the guide member, which is also where the majority of the material to be sieved tends to flow. As a result the effectiveness of the sieve can be increased.

The material to be sieved may be a dry particulate solid or a liquid containing solid (or at least non-flowable) parts. In the case of a liquid the guide member can allow an increased head of the liquid to be retained over the sieve screen, which improves throughput rate.

Instead of being secured to the sieve screen, the guide member may be only in contact with the screen, e.g. pressing against the screen with sufficient pressure to enable vibrations in the guide member to be transmitted to the screen to provide the deblinding excitation.

According to a second aspect of the present invention there is provided a sieve comprising:

a base, a circular sieve screen frame mounted on the base, a circular sieve screen mounted in the frame and having a centre, a vibrator arranged to vibrate the frame relative to the base, a resonator secured to or contacting the sieve screen, wherein the resonator takes the form of a spiral-like curve starting near the centre of the sieve screen, the curve having a progressively increasing radius of curvature and extending through at least 270° about said centre; and an excitation source arranged to excite the resonator, to induce a deblinding excitation of the sieve screen.

The progressive increase in curvature may be continuous or in one or more steps. This provides the advantage that the excitation is spread more effectively over the surface of the screen than with prior art sieves, especially for large diameter sieves.

Although ultrasonic excitation of the sieve screen has been discussed previously, the invention is not so limited. For example, the sieve screen may be excited at lower frequencies, or even by hitting or tapping the guide member.

According to a third aspect of the invention, there is provided a sieve comprising: a base, a sieve screen frame mounted on the base, a separator screen mounted in the frame, a vibrator arranged to vibrate the frame relative to the base, a resonator secured to or contacting the separator screen, wherein the resonator comprises a rod extending between spaced ends, an ultrasonic transducer at one of said spaced ends to excite the resonator rod at a resonant frequency having a predetermined wavelength along the length of the resonator rod, said resonator rod having at least a portion of its length which bends smoothly in a single direction of curvature through at least 90°, and the rod having a minimum radius of curvature at any point between said spaced ends which is greater than said predetermined wavelength.

BRIEF DESCRIPTION OF THE DRAWINGS

Embodiments of the present invention will now be described with reference to the accompanying drawings, in which.

DETAILED DESCRIPTION OF THE PREFERRED EMBODIMENTS

Figure 1:
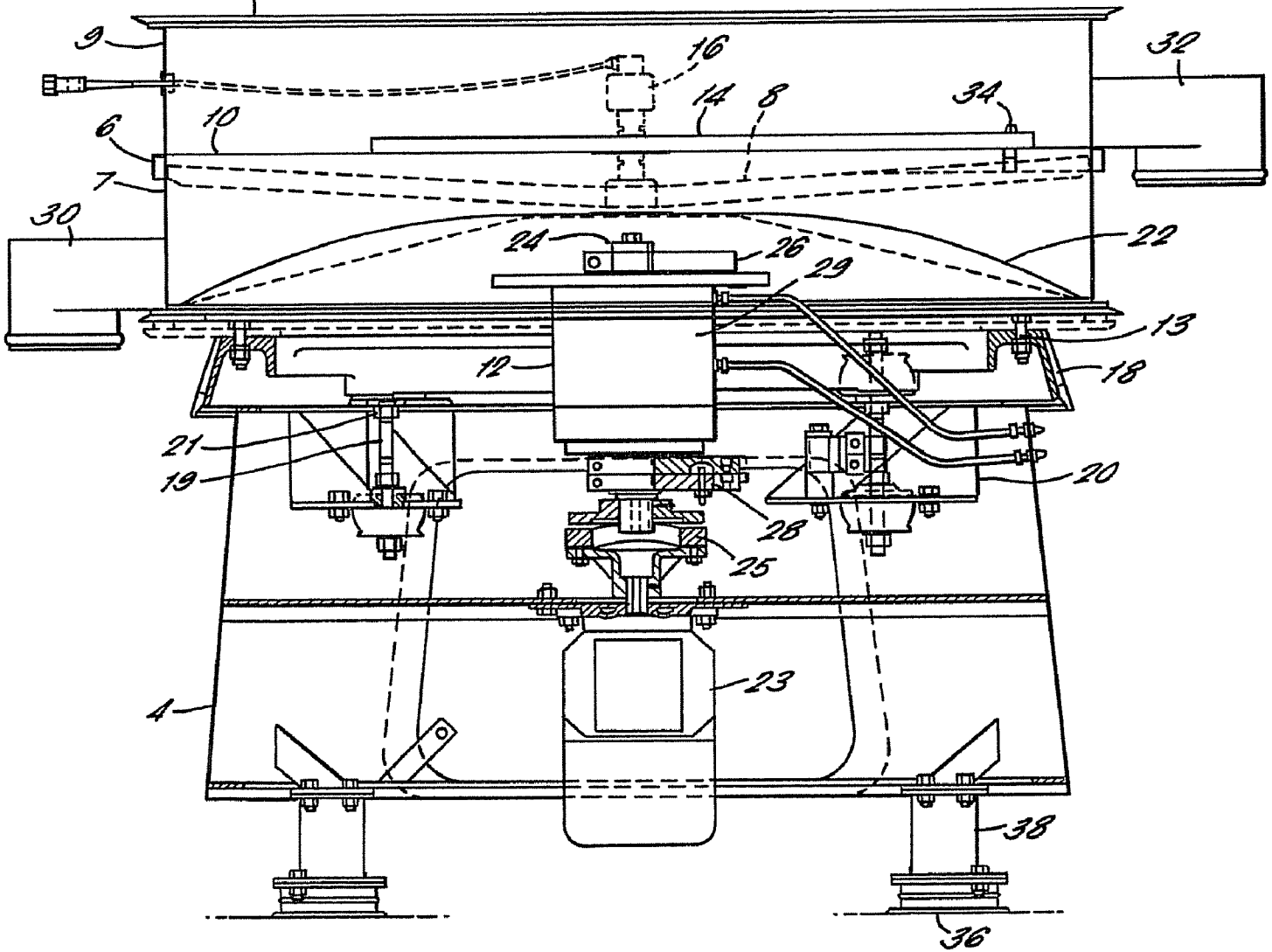
FIG. 1 is a schematic diagram of a sieve embodying the present invention.

Referring now to FIG. 1, this shows a sieve 2 embodying the present invention. The sieve 2 comprises a sieve screen 10 in the form of a mesh, which is held in a sieve screen frame 6, for example by clamping. The frame 6 and sieve screen 10 may be rectangular but a popular circular shape is shown in this example.

The sieve screen frame 6 includes an inner support frame 8, which may take the form of an 'X' frame, although it may take other forms. The sieve screen frame 6 is attached to a lower cylindrical container 7, for example by clamping. An upper cylindrical container 9 is secured, e.g. also by clamping, on top of the screen frame 6 to act as a containment wall for the product to be sieved when it is on the sieve screen surface 10.

The lower container has a domed floor 22. The lower container is secured on a skirt-shaped annular casting 18, e.g. by clamping.

The sieve also has a fixed base 4 which is attached to the floor 36, in this embodiment by using sieve stands 38. However, in alternative embodiments the base may simply stand on a suitable surface, may be fixed to a suitable surface or may be arranged on wheeled or other mounts.

The skirt is supported on the fixed base using a suspension support 20. In this particular embodiment the suspension support 20 comprises a rod 19 attached to the casting 18 and base 4 using elastomeric bushings 21. This arrangement permits both horizontal and vertical movement of the casting 18 and therefore of the sieve frame 6 and sieve screen 10. Other methods may be used for supporting the sieve screen frame on the fixed base, for example spring mounts.

A motor 23 is mounted on the fixed base 4 and flexibly attached, for example using a rubber coupling 25, to a vibrator 12. The vibrator 12 comprises a bearing housing 29 secured in the centre of the casting 18, a motor shaft 24 which when the motor is at rest is generally vertical, and upper and lower eccentric weights 26, 28. The upper eccentric weight 26 is attached to the upper end of the motor shaft 24. The lower eccentric weights 28 are attached to the lower end of the motor shaft 24. In this example the mass of the lower weight is greater than that of the upper weight. However, the effective eccentricity of the mass of one or both of the upper and lower weights may be adjustable and the relative angular positions of the two weights on the motor shaft 24 can also be altered. By altering the effective eccentricity and the positions of the masses the vibration transmitted using vibrator 12 may be varied to give optimum sieve performance for particular applications.

In use, vibrator 12 in combination with the suspension mounting of the skirt 18 will result in vibratory motion being imparted to the sieve screen frame 6 and thereby the sieve screen 10, such a motion having both horizontal and vertical components.

A guide member 14 is located on the sieve screen surface 10 and the guide member is used to control the flow of the material to be sieved over the sieve screen surface. An excitation source 16 is attached to the guide member 14 and excites the guide member, preferably so that it moves in a vertical direction. The guide member 14 thereby preferably drives a vertical vibration of the sieve screen 10. The excitation source 16 of this particular embodiment is additionally attached to the X-frame 8 for support. The various methods of excitation and fixation will be described in more detail subsequently.

For simplicity, how the material to be sieved is supplied to the sieve 12 is not shown. However, this may be at any point on the sieve screen surface, but is typically at or near the centre of a circular sieve or at one end of a rectangular sieve.

An outlet 32 for removal of oversized particles is shown and this will remove particles which remain on the sieve screen surface. Once particles with a size smaller than the apertures in the sieve screen frame have fallen through these apertures they are directed by the dome 22 towards an outlet 30 for fines. The dome 22 serves an additional purpose of preventing material which has fallen through the sieve screen from fouling the vibrator 12, and in particular the upper eccentric weight 26. Although a dome is depicted in this particular embodiment, this feature may take other forms, for example a cone or a continuous slope across the width of the sieve.

Also shown in this embodiment is a support device 34 which is attached to the guide member and is supported on the X-frame 8. The forms which may be taken by the support device 34 will be discussed subsequently.

Figure 2:
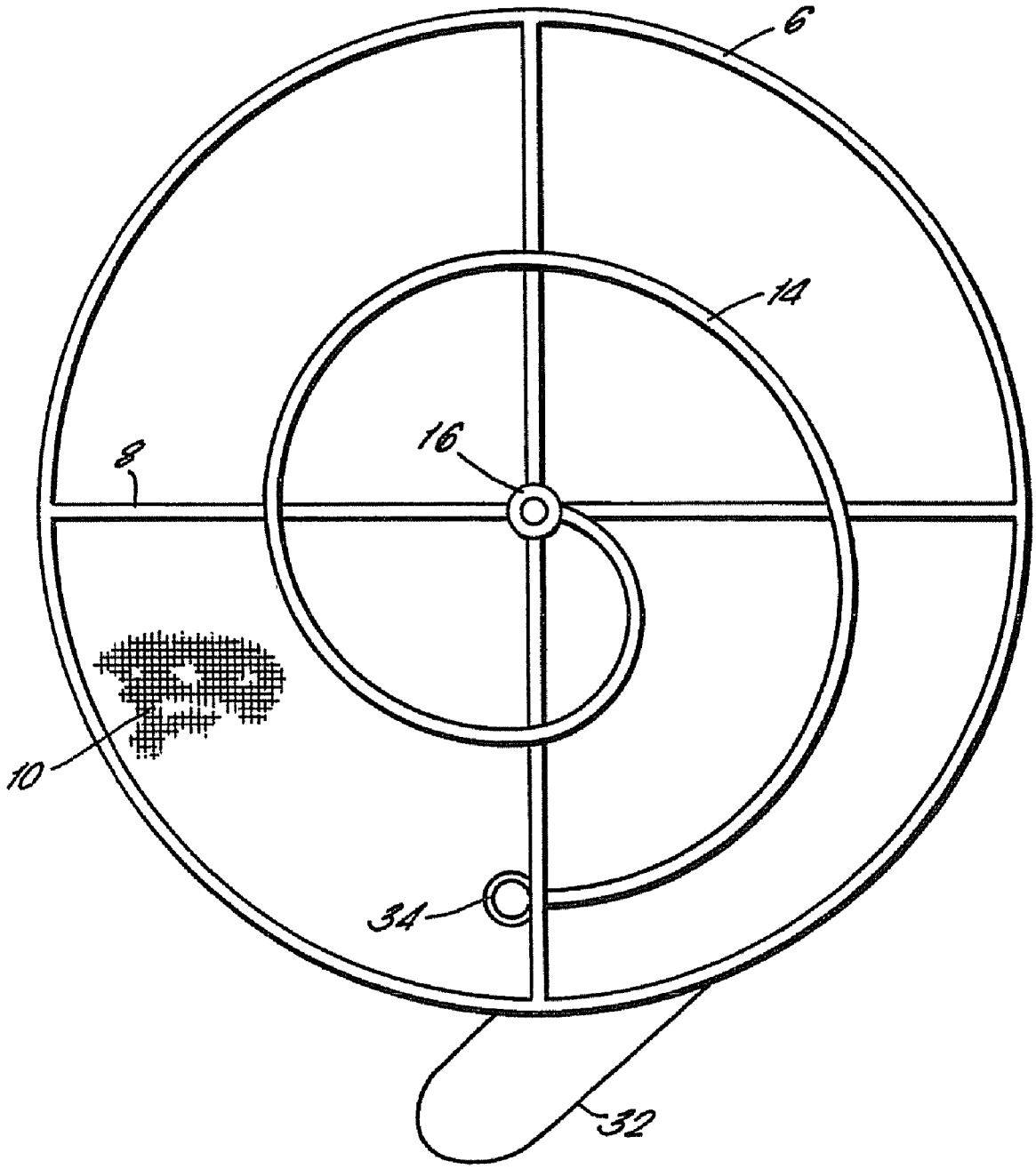
FIG. 2 is a plan view of the embodiment of FIG. 1.

FIG. 2 shows a plan view of the sieving apparatus 2 of FIG. 1. The sieve 2 has a circular sieve screen frame 6 in which is secured a circular sieve screen 10 and in addition an X-frame 8. On the surface of sieve screen 10 is located the guide member 14. The guide member 14 is secured to the sieve screen, for example using an adhesive. The guide member 14 in this embodiment takes the form of a spiral-like shape having an inner end approximately at the centre of the sieve screen 10 and extending outwards with a steadily increasing radius of curvature through approximately 540°. The guide member 14 is secured to an excitation source 16 which is located substantially at the centre of the sieve screen 10 and is supported on the X-frame 8. A support device 34 is located at the opposing end of the guide member 14 to support the guide member on the sieve screen 10. There may also be other supports of the same or different type.

In use the vibrator 12 produces a substantially gyratory motion of the sieve screen 10. This movement encourages the flow of the material to be sieved outwards from the centre over the sieve screen surface. However, the material may be moved too quickly over the sieve screen surface to the outside of the screen so that fines can be carried with the oversized particles to the outlet 32, reducing efficiency. The guide member 14 controls the flow of material over the sieve screen surface and thereby increases the residence time of material on the sieve screen surface. This increases the efficiency of the sieve, since there is a greater opportunity for fines to fall through the sieve screen apertures. Although it is known to optimise performance for different materials by adjusting the out-of-balance weights 26 and 28 as mentioned above, this is a time consuming adjustment. The guide member 14 can ensure good sieving performance over a wide range of materials. The guide member 14 is a bar-like member, typically having an L-shaped or rectangular section presenting sufficient height above the screen surface to restrict or substantially prevent material from crossing over the guide member during sieving.

As mentioned above, the guide member 14 is excited by excitation source 16 to impart deblinding excitation to the sieve screen 10. In a preferred example, which will be described in more detail later, the excitation source 16 is a source of ultrasonic vibration, and is adapted to excite the guide member 14 resonantly. In order to be a good transmitter of ultrasonic energy, the guide member should be preferably of metal, such as aluminium or stainless steel. The guide member 14 ensures the excitation energy from source 16 is distributed over the screen 10, to increase the area of the screen 10 which is sufficiently excited to provide effective deblinding.

Figure 3:
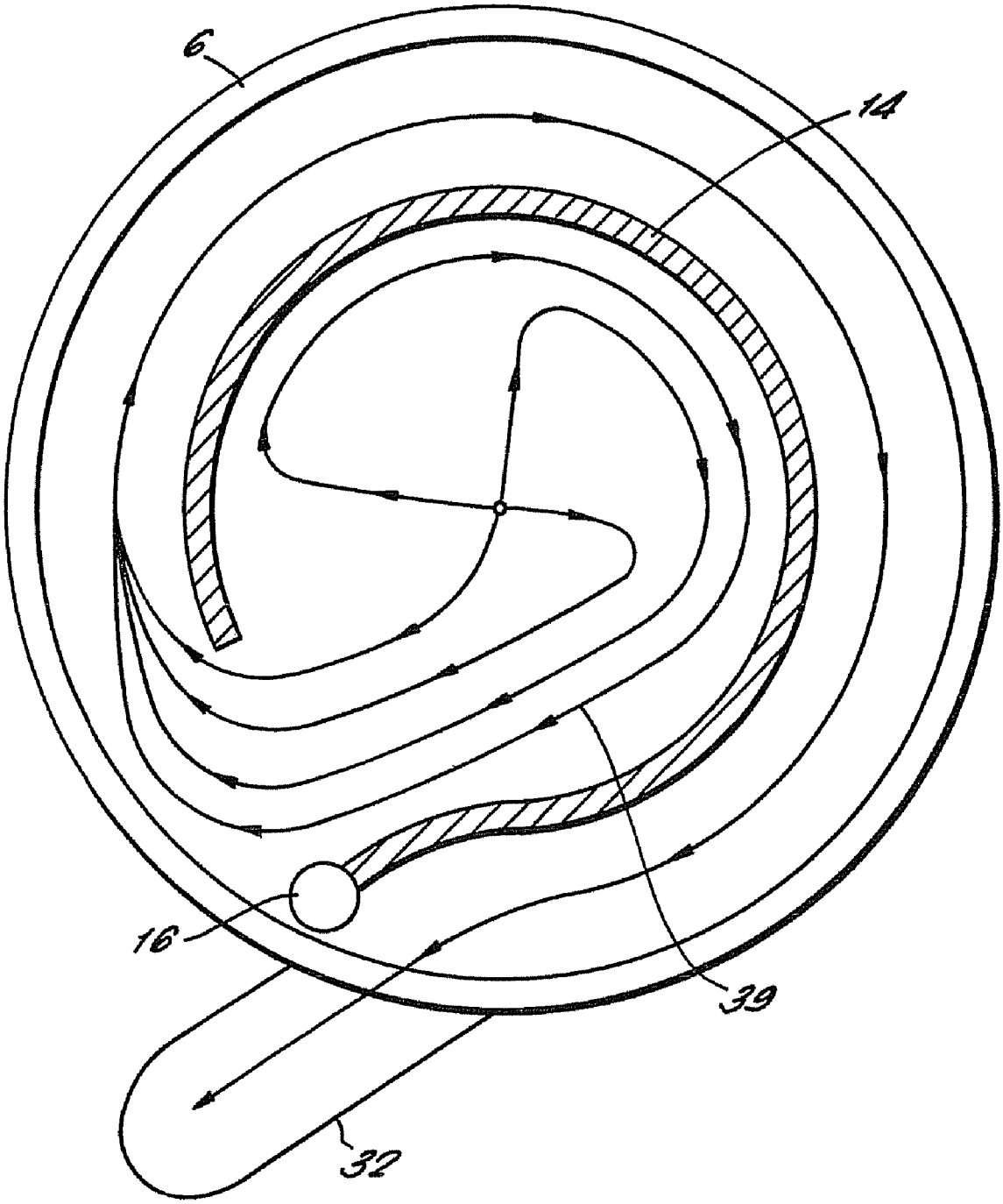
FIG. 3 is a plan view of a further embodiment, showing the flow pattern of material over the sieve screen surface.
Figure 4:
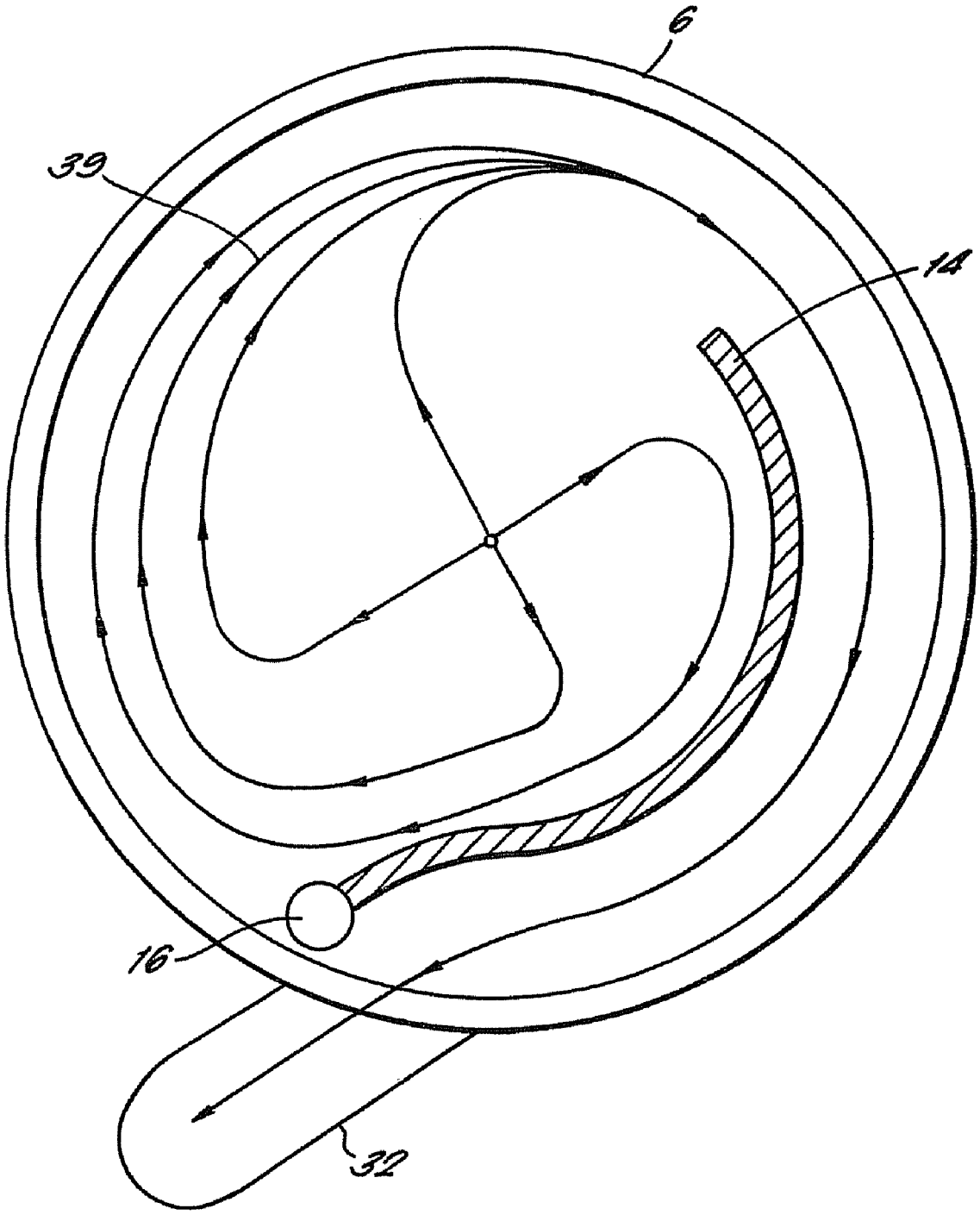
FIG. 4 is a plan view of a still further embodiment, showing the flow pattern of material over the sieve screen surface.

FIGS. 3 and 4 show alternative configurations of the guide member 14. In these embodiments the excitation source 16 is located towards the oversize outlet 32. In FIG. 3, the guide member 14 has a circular part extending over about 300° of arc, which is secured to be generally concentric in the sieve frame 6. One end of the arc bends outwards towards the frame 6 to the excitation source 16. In FIG. 4, the circular part extends over only about 150° of arc. The flow patterns 39 for the material being sieved are also shown, from which it can be seen that the material enters substantially at the centre of the sieve 2 and moves radially outwards from the point of entry in all directions. The guide member 14 alters the flow of the material so that it is directed in a spiral-like manner over the sieve screen surface 10. This increases exposure of the material to the sieve screen and also the time the material is resident on the sieve screen surface. Although no support device 34 is shown in either FIG. 3 or 4, if required this may be attached similarly to the guide member 14 as shown in FIG. 2.

Figure 5:
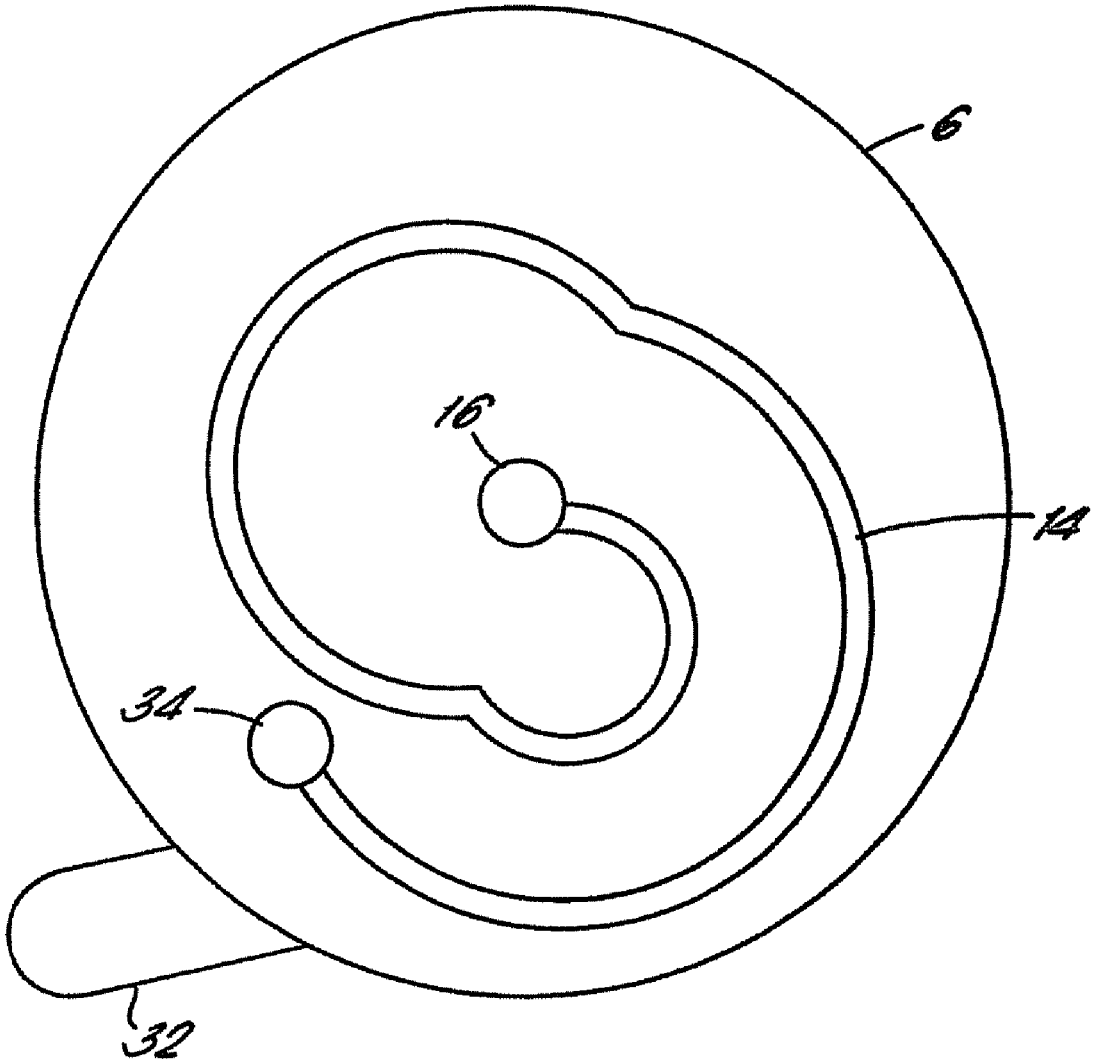
FIG. 5 is a plan view of a still further embodiment.

FIG. 5 shows a further alternative for the shape of the guide member 14. Again, the guide member 14 has one end substantially at the centre of the sieve screen 10. However, in this embodiment the guide member is made up of inter-connected sections, each section having a constant radius of curvature. The points of interconnection of the sections provide cusp-like formations, which tend to deflect material inwards on the sieve screen as the material flows around inside the guide member 14. This results in the material being exposed to more of the sieve screen surface and gives a greater opportunity for the fines to pass through the sieve screen aperture.

Figure 6:
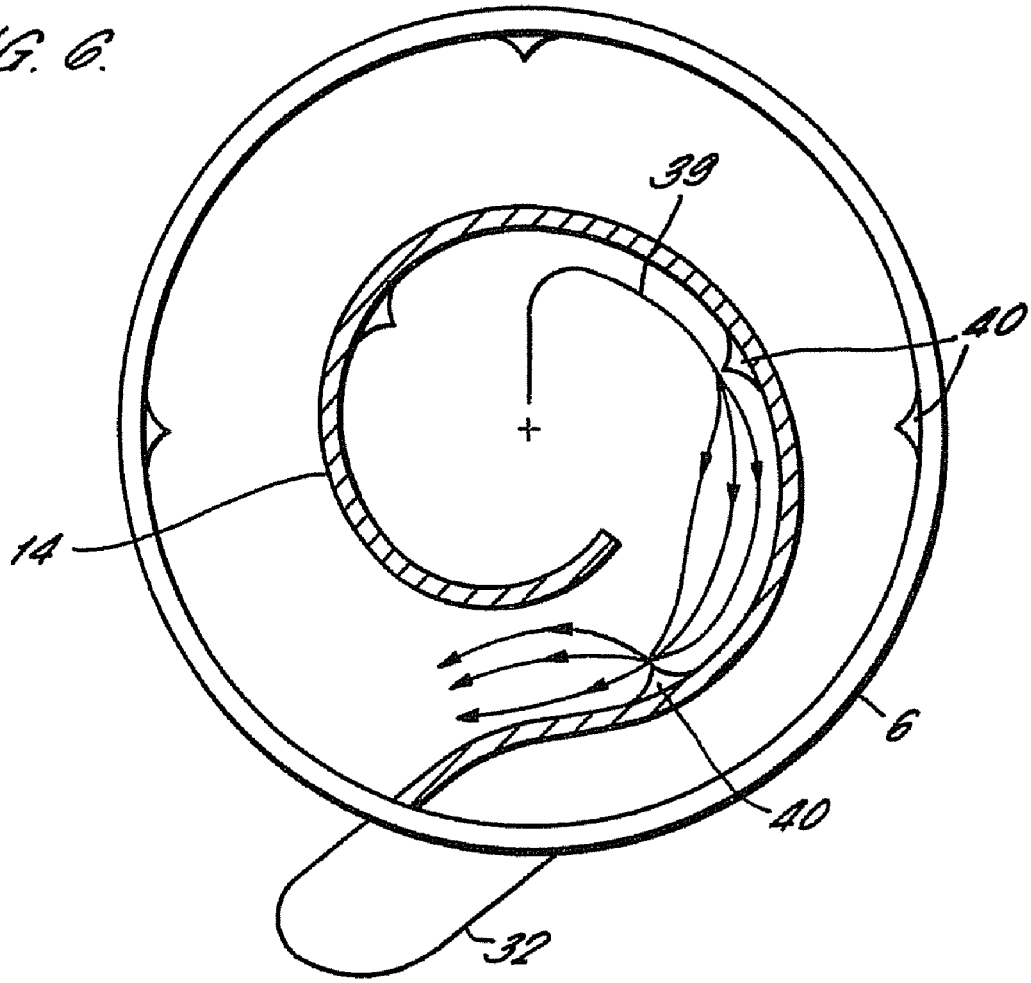
FIG. 6 is a plan view of a still further embodiment, showing partial flow patterns over the surface of the sieve screen.
Figure 7:
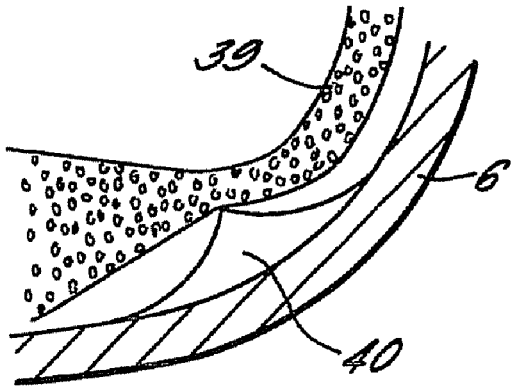
FIG. 7 is an enlarged view of a portion of FIG. 6.

FIG. 6 shows a further embodiment of the present invention. To assist in movement of the material across the sieve screen surface cusps 40 are attached to a spiral shaped guide member 14 and also the inner edge of the sieve screen frame 6. As shown in more detail in FIG. 7 the cusps 40 act in a manner similar to that described in respect of FIG. 5 by deflecting material inwards as it flows past against the guide member 14 or the frame edge. The cusps 40 may be incorporated into the guide member 14 and sieve screen frame 6 during manufacture, or by the addition of separate pieces attached by welding, or any other form of mechanical attachment subsequent to manufacture.

Figure 8:
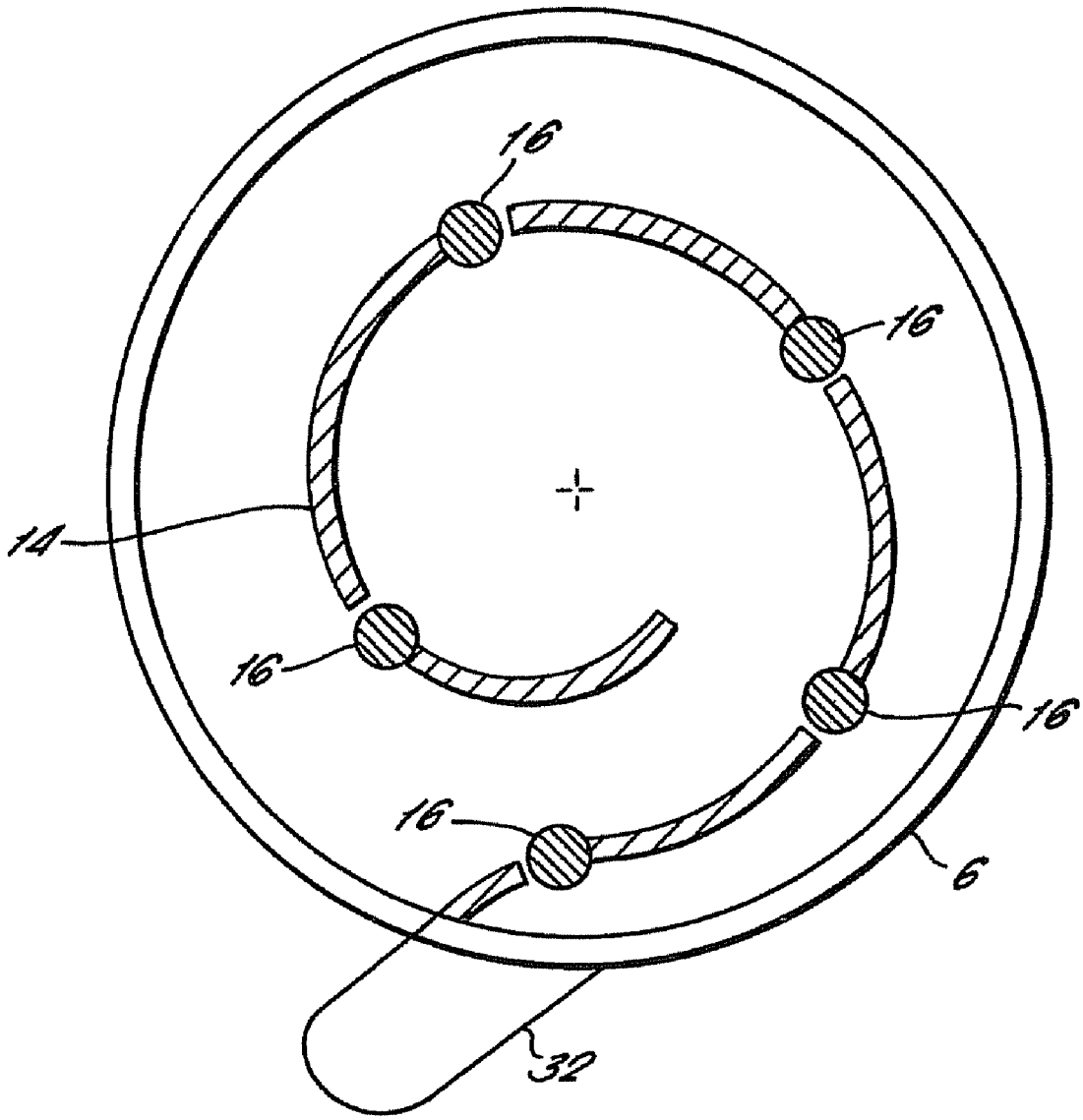
FIG. 8 is a plan view of a still further embodiment.

FIG. 8 shows a plan view of an embodiment of the present invention which is particularly suited for use in wet applications as well as dry applications. A plurality of separate guide members 14 each have a respective excitation source 16. The guide members have minimal gaps between the end of one and the start of the next and together form a spiral shape so that the flow of material is directed over the sieve screen surface as for the single spiral shaped guide member. The multiple guide members may take other forms as required to control material flows over the sieve screen. For example, the sections could be straight sections, particularly for a rectangular sieve. The use of additional excitation sources is advantageous, particularly though not exclusively for wet applications, whenever a greater amount of energy is required for deblinding excitation of the sieve screen 10, e.g. to counter increased damping.

Figure 9:
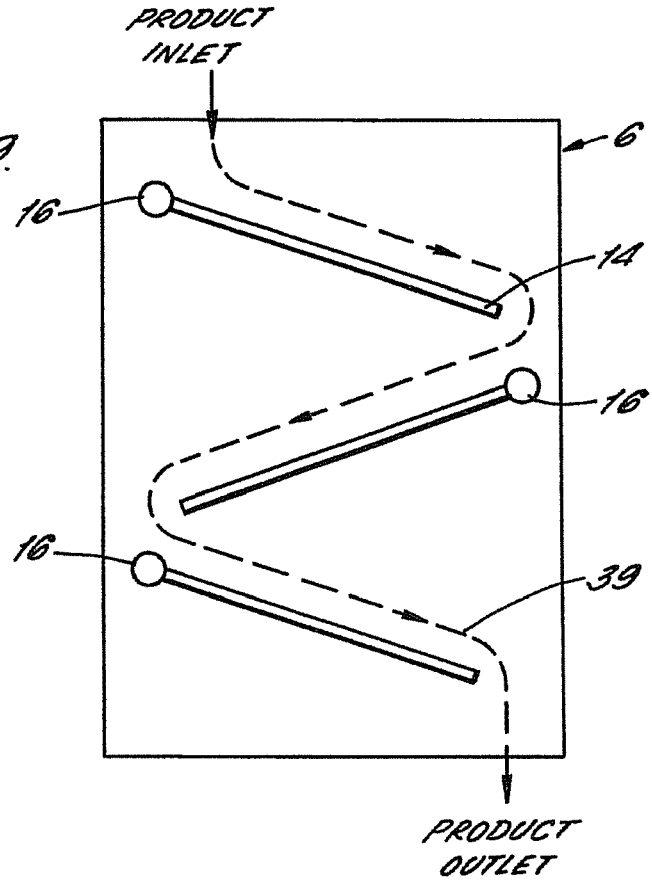
FIG. 9 is a plan view of a still further embodiment, which also shows the flow pattern of material over the screen surface.
Figure 10:
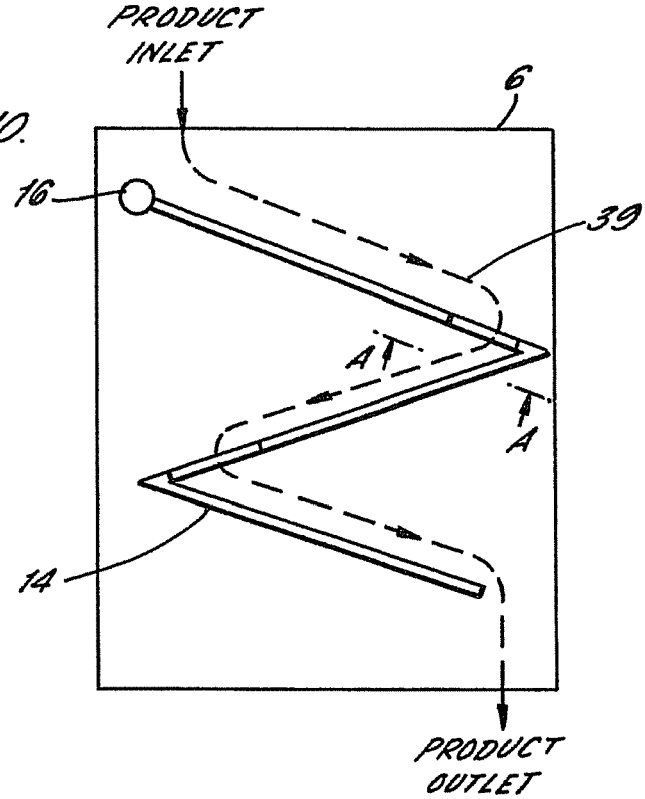
FIG. 10 is a plan view of a still further embodiment.
Figure 11A:
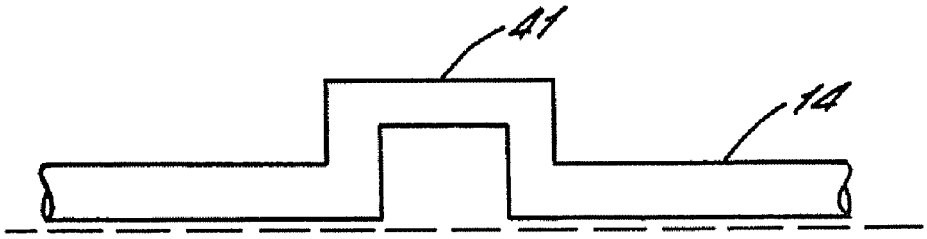
FIGS. 11*a-d* are detailed views of the guide member arrangement of FIG. 10.
Figure 11B:
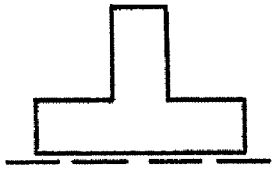
Figure 11C:
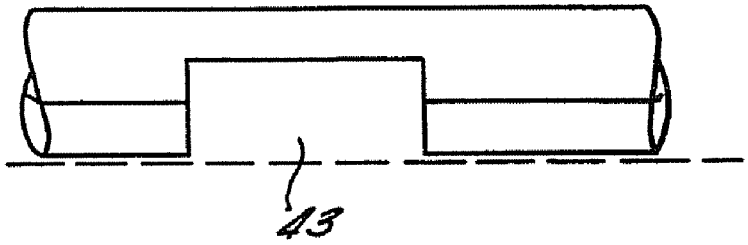
Figure 11D:
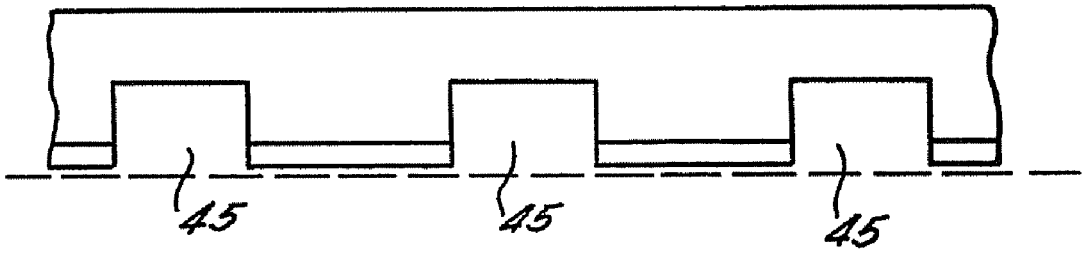

The previously described embodiments of the present invention have been circular sieves. However, the present invention is also applicable to rectangular sieves, and examples are shown in FIGS. 9 and 10. In these examples, the action of the sieve tends to transport material over the sieve screen from one end to the other, e.g. top to bottom in the drawings. Guide members 14 directs the flow in a path traversing the sieve from one side to the other, maximising the sieve screen surface covered and residence time on the sieve screen. As before, the guide member 14 may be multiple with respective excitation sources 16, as shown in FIG. 9, or there may be a single zig-zag guide member with a single excitation source 16 as shown in FIG. 10. In the latter case the flow path must pass through the guide member and FIGS. 11*a* to *d* illustrate two methods in which this may be achieved. FIG. 11*a* shows a bridge 41 formed in the guide member where a portion of the guide member 14 is raised to form an opening for the material to flow through. FIGS. 11*b* and *c* show a guide member 14 which has a T-cross section, and from which a portion 43 is removed to provide an opening for the product to flow through. In another embodiment, shown in FIG. 11*d*, the guide member 14 has multiple openings 45 along its length.

Figure 12:
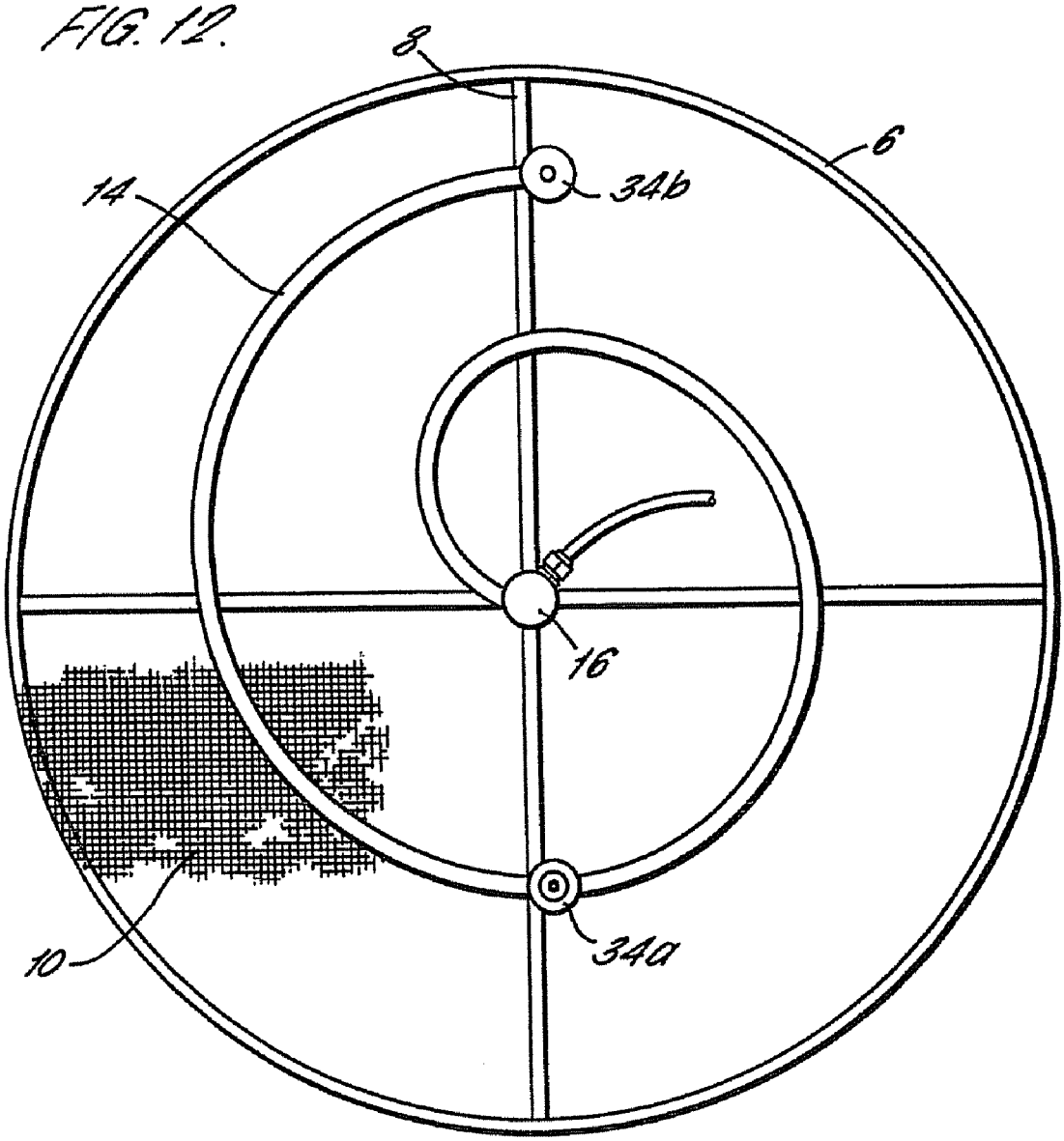
FIG. 12 is a plan view of a still further embodiment.
Figure 13:
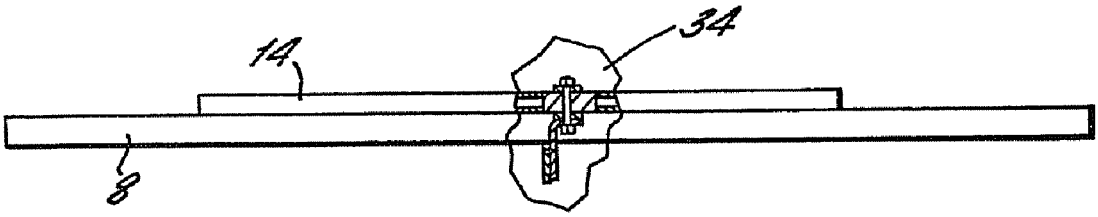
FIG. 13 is a scrap cross-sectional view through FIG. 12 showing an enlarged view of the nodal decoupler.

FIG. 12 shows an embodiment similar to that of FIGS. 1 and 2 in which the spiral shaped guide member 14 is driven ultrasonically by a centrally mounted excitation source 16. The guide member 14 is supported part way along its length and at its outer end by respective supporting devices 34*a* and 34*b*. The device 34*a* is further illustrated in scrap section in FIG. 13 and will be described in detail below with reference to FIG. 16.

As has been previously mentioned, the guide member may be ultrasonically excited, commonly at frequencies above 20

Figure 16:
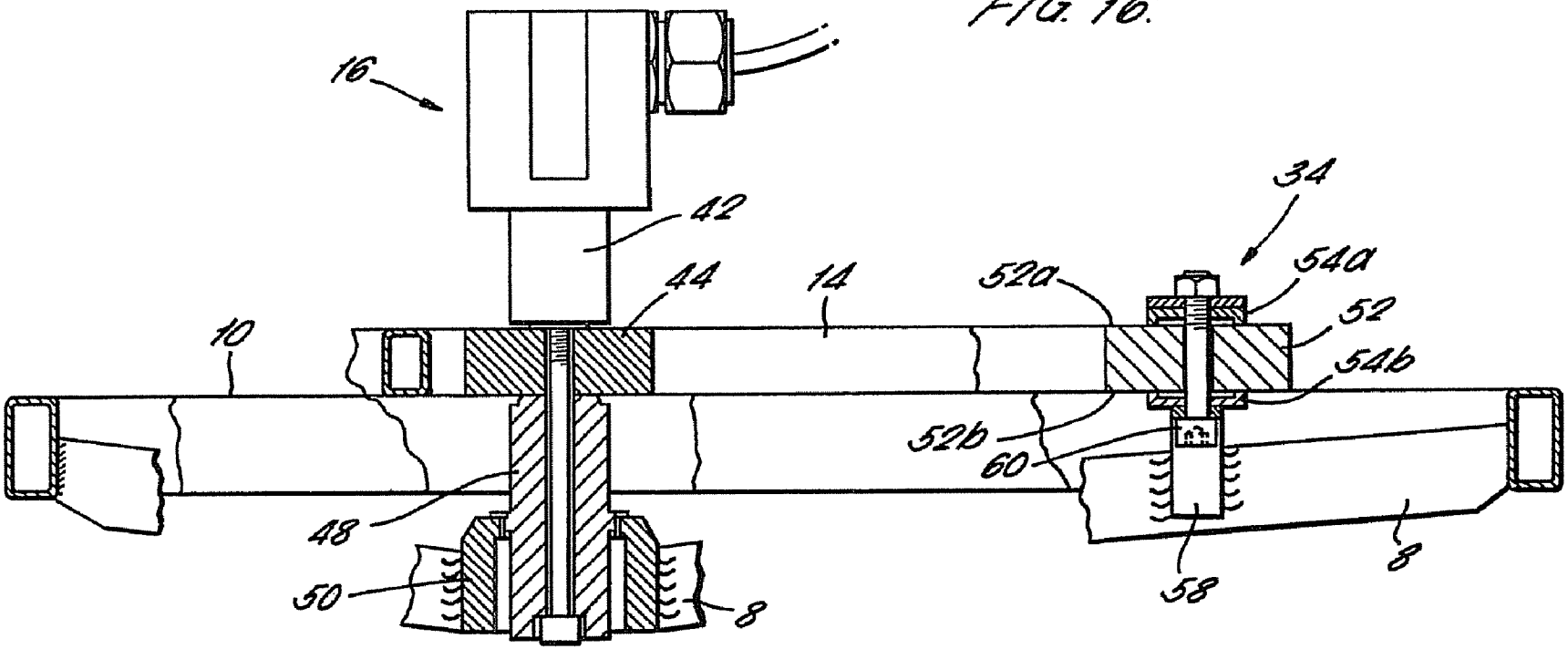
FIG. 16 is a cross-sectional view taken along line B-B in FIG. 14.

KHz. FIG. 16 provides a detailed illustration of an excitation source 16 configured to provide ultrasonic excitation and a support device 34 which is suitable for use with ultrasonic frequencies.

The excitation source comprises a transducer 42 for converting electrical energy to ultrasonic wave energy, for example by using the piezoelectric effect The transducer may be a half wave stack-type transducer of a kind which will be familiar to those experienced in ultrasonics. A circular resonator boss 44 is attached to the active end of the transducer 42. The resonator 44 converts the longitudinal vibration of the transducer to a transverse diaphragm mode. The excitation source 16 is supported on the X-frame 8 by the use of a central support 48. The dimensions of the central support 48 are chosen such that it is one half wavelength in length so that a node is formed at a point about half way along the length of the central support 48. A cylindrical sleeve 50 is attached to the support 48 at the node point, and the sleeve 50 is secured to the X-frame 8, for example by welding. Because the connection to the central support is at a node, the mounting arrangement decouples the transducer 42 from the X-frame 8, minimising loss of ultrasonic energy to the frame.

The resonator 44 is attached at its outer periphery to the guide member 14 to transmit ultrasonic energy to the guide member. The dimensions of the guide member 14 are preferably chosen so that the length is approximately a whole number of half wavelengths, so that the guide member 14 can be driven in resonance to maximise the transfer of ultrasonic energy from the transducer 42 into the guide member 14. However, the guide member 14 would normally be a substantial number of half wavelengths long. Therefore, it is not necessary to make the guide member to have a length precisely equal to a whole number of half wavelengths, as it can readily be brought into resonance by a small change in the drive frequency of the transducer 42, without great loss of efficiency. Also, in some applications, vibration of the guide member 14 may be damped, e.g. by the loading of the sieve screen and material to be sieved, to such a degree that little vibration energy is reflected at the far end of the member. Then, the guide member functions as a non-resonant transmission member rather than as a resonator.

Although resonator boss 44 is illustrated interconnecting the transducer 42 and the guide member 14, in some applications it may be satisfactory to connect the transducer 42 directly to the guide member 14 or through a different coupling system.

Also shown in FIG. 16 is a support device 34 (corresponding to device 34*b* in FIG. 12) designed to support the guide member 14 on the sieve screen 10. At ultrasonic frequencies it is preferable to provide a support device 34 which ultrasonically decouples the guide member 14 from the support frame, to which it is attached.

Accordingly, the support device 34 comprises a cylindrical resonator boss 52, that may be similar to boss 44, which is attached to the guide member 14, so that a diaphragm mode of vibration is excited in boss 52. At least one diaphragm mode node is therefore formed at a predictable position on the resonator boss 52. Decoupling washers 54*a*, 54*b* have skirts which are located against the upper and lower surfaces 52*a*, 52*b*, of the resonator boss 52, at the diaphragm mode node. These decoupling washers 54*a* and 54*b* therefore experience minimal excitation. A support bracket 58 welded to the X-frame 8 engages the lower decoupling washer 54*b*. A bolt 60 is used to clamp the resonator boss 52 between the washers 54*a* and 54*b* and the support flange 58 to secure the boss to the X-frame 8. The bolt 60 extends through an oversize hole in the resonator boss 52, so as not to contact the body of the resonator boss 52. This configuration effectively decouples the guide member 14 from the X-frame 8, since the only point of contact with the resonator boss 52 is at the diaphragm mode node, i.e. a point of minimum vibration. This nodal decoupling boss is also described in GB-A-2343392. A similar construction is used for the support device 34*a* of FIGS. 12 and 13.

The boss 52 may be excited to resonate in other modes, provided the point or points of contact with the boss are made at appropriate nodal points of the resonant mode to ensure decoupling.

Figure 14:
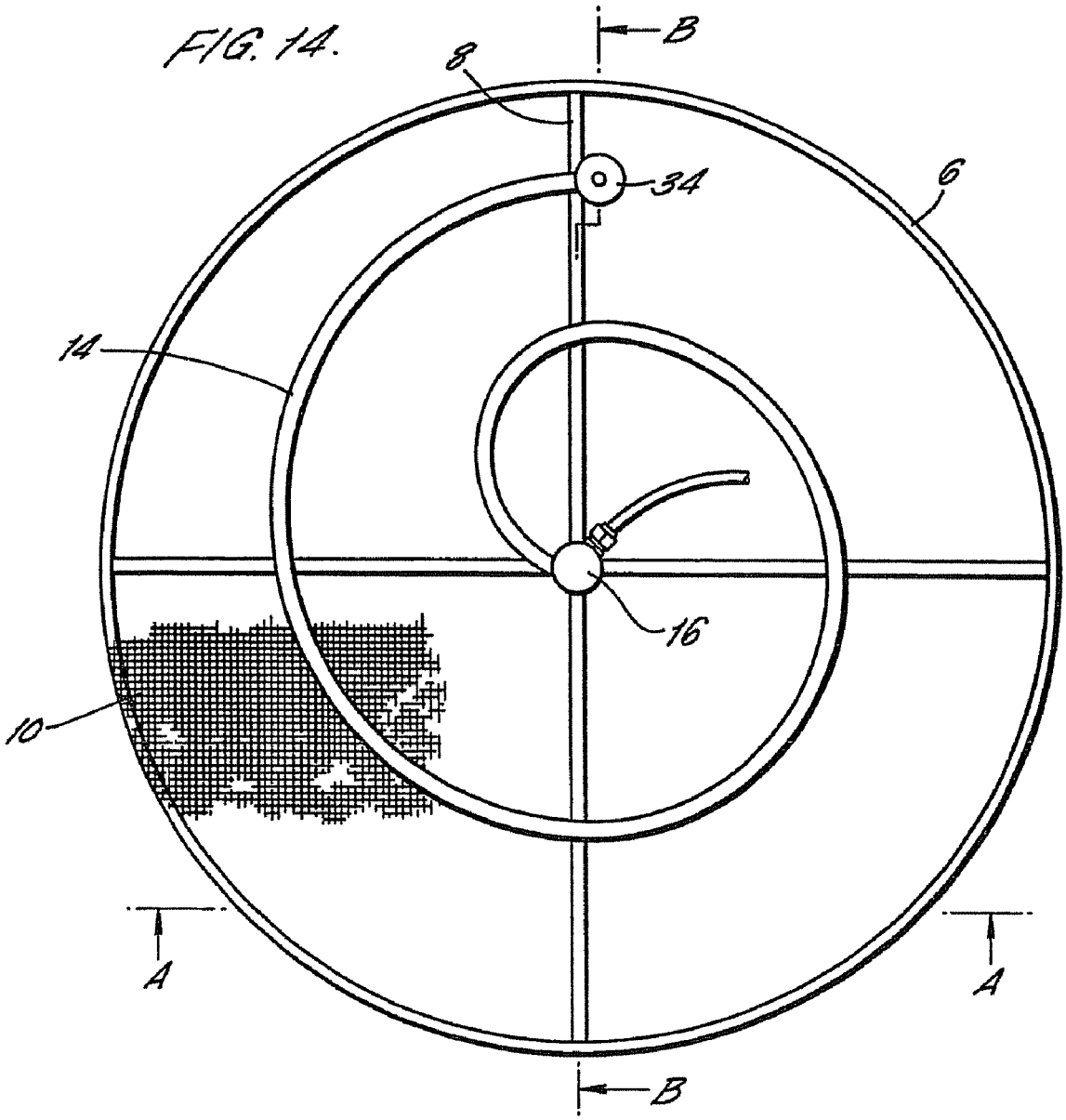
FIG. 14 is a plan view of a still further embodiment.
Figure 15:
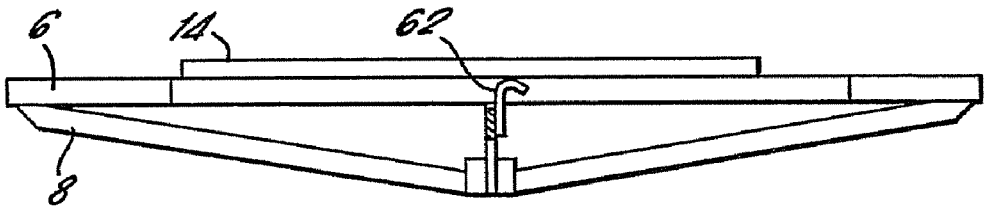
FIG. 15 shows a cross-sectional view along line A-A of FIG. 14.

FIGS. 14 and 15 show an alternative supporting arrangement for the guide member 14. FIG. 15 shows flange 62 in the form of an inverted J, which is attached to the X-frame 8 and to the guide member 14. Although this construction of support provides less effective ultrasonic decoupling of the guide member 14 from the X-frame 8, this may be sufficient for many purposes, provided the area of contact with the guide member 14 is small compared to a quarter wavelength of the resonant vibration of the member 14.

As has been previously mentioned, the excitation may be at various different frequencies and the excitation source may comprise a number of alternatives. For example, instead of using an ultrasonic transducer the excitation source 16 may comprise a pneumatic actuator vibrating the guide member 14 at lower frequencies, e.g. several tens or hundreds of hertz. This is particularly advantageous in applications where the use of an electrically powered actuator may pose a fire or explosion risk. A suitable pneumatic actuator is described in International Patent Application WO 03/024626. The pneumatic vibrator may provide an impulse-type excitation of the guide member, e.g. by means of a reciprocating mass in the pneumatic actuator, to cause high frequency resonant vibrations (or ringing) of the guide member.

Alternatively, electrically powered actuators may be used to provide lower frequency excitation.

Therefore in summary, mechanical, electro-mechanical, pneumatic and other forms of actuators may be used in the excitation source of embodiments of the present invention. Particularly at lower excitation frequencies it may not be necessary to excite the guide member at resonance, and the above described arrangements for decoupling excitation energy at the supports for the guide member and/or the transducer may also not be required.

Although in the previously described embodiments the excitation source is directly coupled to the guide member, in other embodiments the excitation source may not be permanently connected to the guide member, but may instead have a striking surface arranged to strike the guide member when the excitation source is energised. Also, the excitation source may be parasitic, that is dependent on the primary sieving action of the sieve frame. For example, the excitation source may comprise one or more free or resiliently mounted parasitic bodies which are caused to move by the primary sieving action and to strike the guide member to produce the required deblinding excitation. Striking of the guide member, either by a separately energised actuator or by a parasitic body, may induce resonant high frequency ringing of the guide member.

Although the excitation source or transducer is shown in the previously discussed embodiments as being supported on an 'X' frame, the excitation source may in fact be wholly supported by the screen, or may be supported at least partially by a flexible or rigid coupling to the frame or the fixed base.

The "sieve screen" may comprise a number of layers, for example it may comprise a first screen and second screen arranged above and supported by the first. In such multi-screen sieves, one or more of the guide members arranged on the screen may be directly excited by the excitation source.

In all the embodiments described above, a guide member is fastened to the top of the sieve screen in order to control the flow of material to be sieved over the screen surface, as well as to provide for an effective deblinding excitation of the screen itself. In a further embodiment, a spiral shaped resonator is fastened beneath the screen. FIG. 2 of the drawings is also a schematic representation of this embodiment, except that the spiral resonator 14 illustrated in the drawing is secured beneath the sieve screen rather than on top. The spiral shape may have a continuously increasing radius of curvature (as in FIG. 2) or the radius may increase in one or more steps. Further the resonator 14 need not have a profile designed to provide a good deflecting action as is necessary when acting as a guide member on top of the screen. Instead, the resonator 14 may be a simple rectangular section tube or solid bar, or else may have a strap shape having a larger dimension secured to the screen. In each case, the resonator 14 should preferably be made of metal or of another material which is an excellent propagator of acoustic energy.

The resonator 14 is excited by an ultrasonic transducer connected to the resonator 14 at the centre of the spiral as shown as 16 in FIG. 2. Again the transducer and the spiral may be supported on an X-frame 8 beneath the sieve screen by decoupling arrangements as illustrated in FIG. 16, except that the resonant bosses 44 and 52 shown in FIG. 16 would be also located beneath the sieve screen.

The spiral resonator 14 is driven to resonance so that deblinding excitation is distributed over the sieve screen to increase the area of the sieve screen which is effectively excited so that blinding can be minimised. In order to provide effective distribution of the ultrasonic energy over the sieve screen area, the spiral should extend through at least 270° of arc, and preferably more than 360° of arc, as illustrated in FIG. 2.

Importantly, the spiral design can allow deblinding excitation to be distributed to a screen of larger sizes by increasing the number of turns of the spiral. In this way almost any practical screen size can be excited using a single length of resonator driven by a single transducer. This avoids the problems of tuning the different lengths of a multiple rod resonator to the same driving frequency, and the additional complication of using multiple single rod resonators with respective separate transducers.

Although the spiral resonator designs of FIGS. 2, 12 and 14 have the spiral starting at the centre of a circular sieve, it may be preferred to locate the inner end of the spiral away from the centre. It is common for material to be screened to be delivered to the centre of the screen, so that keeping this region clear can be beneficial.

The above advantages may also be obtained with other curved rod resonator designs. By using a gently curved rod resonator secured to the screen, ultrasonic energy can be distributed over the area of a screen, thereby reducing or eliminating the regions of the screen which receive insufficient ultrasonic energy to ensure deblinding during sieving operations. Using a rod resonator extending between spaced ends, and excited by an ultrasonic transducer at one of the spaced ends, resonance of the rod over its entire length can usually be ensured. By providing the rod with a gently curved shape, the ultrasonic energy can be delivered efficiently to all parts of a sieve screen. In order to achieve the appropriate coverage of a sieve screen, the rod should have at least one portion of its length which bends smoothly and in a single direction of curvature through at least 90°. Furthermore, the entire length of the rod should comprise smoothly blended curved or straight portions so that the minimum radius of curvature at any point between the ends of the rod is greater than the wavelength of ultrasonic energy in the rod at the resonant frequency at which the rod is excited. Sharper bends tend to reduce the efficiency with which ultrasonic energy can travel along the rod around the bend and can give rise to reflections of ultrasonic energy at the bend, so that different parts of the length of the rod may prefer to resonate at different frequencies. By forming the rod with smoothly blended components and gentle curves, the whole length of the rod normally acts as a single resonator with ultrasonic energy distributed along the entire length.

Better coverage of the area of screen can be obtained if the curvature of the rod varies over the length of the rod to form a more complex curved shape each as a spiral, a serpentine or S-shape, or a blended combination of straight lines and curves.

In practice, the ultrasonic transducer may be operated to excite the rod resonator at a resonant frequency between 18 kHz and 40 kHz. A preferred operating frequency is about 35 kHz. The corresponding wavelength of ultrasonic energy along the length of the resonator rod is between 25 mm and 35 mm and typically about 30 mm. In most applications, the minimum radius of curvature of a resonator rod should be greater than 50 mm, and preferably greater than 100 mm.

Although the rod should have at least one portion bending smoothly with a single direction of curvature by at least 90°, effective coverage of a screen surface can often more easily be achieved with a rod which bends with a single direction of curvature by at least 180°. It should be understood that a portion of a rod that bends with a single direction of curvature may include a straight line portion separating two curved portions bending in the same direction. The rod portion bending in a single direction of curvature can also be described as having a monotonically changing angle with distance along the portion. This is referred to herein as a monotonically bending or curving portion.

Figure 17:
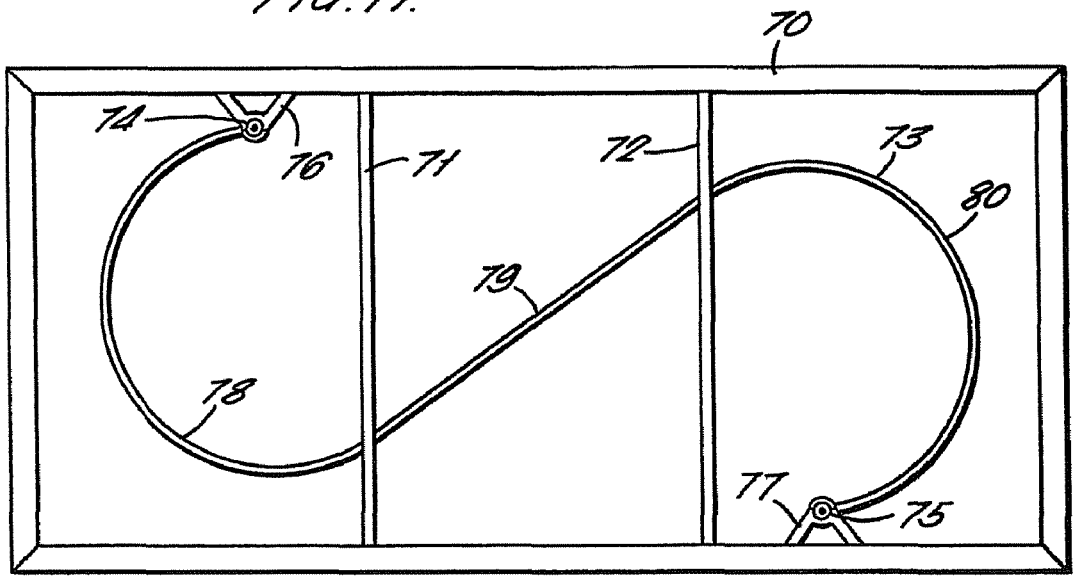
FIG. 17 is an underneath plan view of a further embodiment of the invention incorporated in a sieve with a rectangular frame.

An example of a smoothly curved rod resonator (other than a spiral) is illustrated in FIG. 17. A rectangular sieve frame 70 is illustrated viewed from beneath. The sieve frame 70 carries a rectangular sieve mesh which is omitted in this drawing for clarity. The rectangular sieve frame 70 is braced by struts 71 and 72 extending between the long sides of the rectangular frame so as to be spaced beneath the mesh supported by the frame. An S-shaped resonator rod 73 is bonded to the underside of the screen mesh and is supported at each end by de-coupling mounts 74 and 75. The de-coupling mounts 74 and 75 may comprise a circular resonator boss bonded to each end of the resonator rod 73 and sized to resonate in diaphragm mode at a preferred resonant frequency of the rod 73. Annular de-coupling extensions are bonded to the bosses at diaphragm mode antinodes, to provide mounting points for attachment to brackets 76 and 77 secured to the frame 70. Accordingly, the de-coupling mounts at the ends of the rod 73 may correspond to mounts 34 illustrated in FIG. 16, and also to the de-couplers described in GB-A-2343392.

An ultrasonic transducer is connected to the de-coupling boss 74 to excite the rod 73 along its entire length at a resonant frequency. The wavelength of ultrasonic energy along the rod at this resonant frequency is typically about 30 mm.

As illustrated in FIG. 17, the rod 73 comprises a first monotonically curving portion 78 which bends through about 210°, smoothly connected to a straight portion 79, which is in turn smoothly connected to a further curved portion 80 which also bends monotonically (with curvature of opposite sign to the first curved portion 78) back through about 210° to the termination boss at mounting 75. The radius of curvature of each of the curved portions 78 and 80 is about 300 mm.

As can be seen from the Figure, the illustrated design provides excellent coverage of the rectangular screen 70, so that no part of the screen surface is more than about 400 mm from a source of ultrasonic energy, even though the sieve mesh itself is about 1 meter wide and about 2 meters long.

Figure 18:
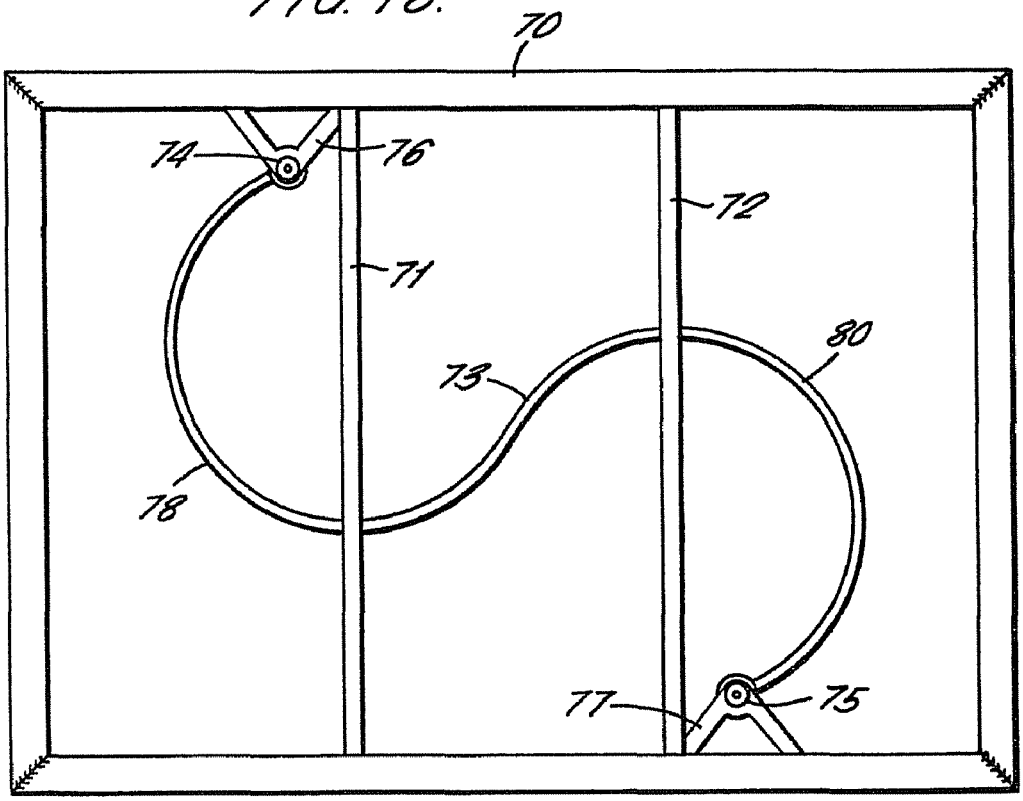
FIG. 18 is an underneath plan view of a variation of the embodiment of FIG. 17.

FIG. 18 illustrates a further example applied to a shorter rectangular sieve frame of about 1 meter by 1.4 meters. In this illustration, the same reference numerals have been used to indicate corresponding parts as for the embodiment of FIG. 17. However, the rod resonator 73 essentially comprises only the first curved portion 78 directly blended into the last curved portion 80, with the intermediate straight portion 79 of the FIG. 17 embodiment removed. Each of the curved portions 78 and 80 in FIG. 18 have a radius of curvature of about 250 mm.

Figure 19A:
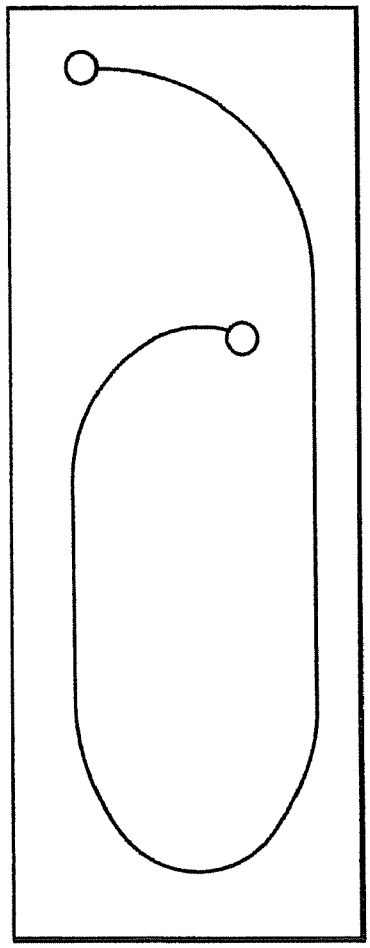
FIGS. 19*a* to 19*f* are schematic illustrations of additional embodiments.
Figure 19B:
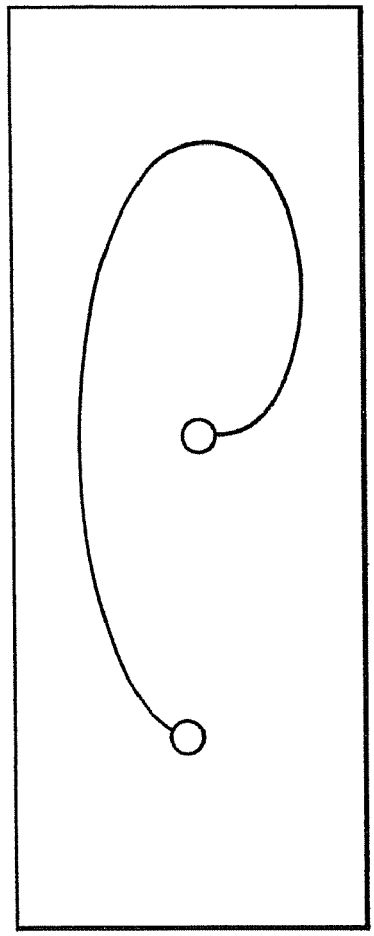
Figure 19C:
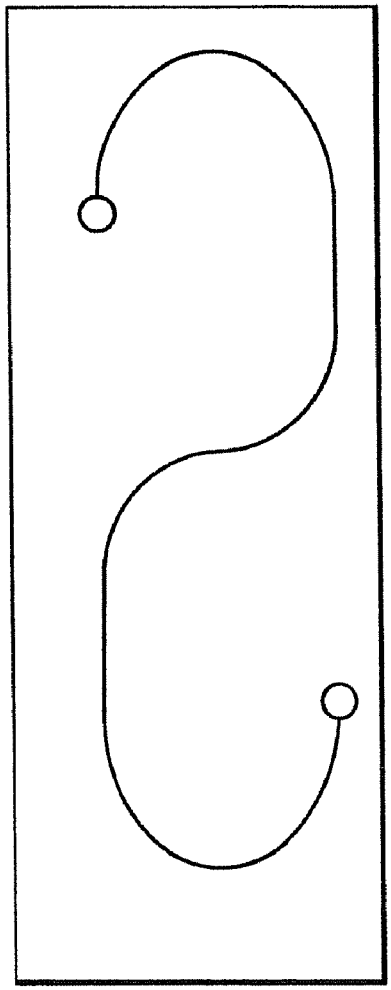

FIGS. 19*a* to 19*f* illustrate further curved rod resonator designs falling within the scope of the invention. In FIG. 19*a*, the rod bends monotonically between the two ends by a total of about 360°. In FIG. 19*b*, the rod bends by a total of about 310° monotonically from one end to the opposite end. In FIG. 19*c*, there is a first portion which bends monotonically through about 270°, smoothly blended with a second portions which bends monotonically in the opposite direction also by about 270°.

Figure 19D:
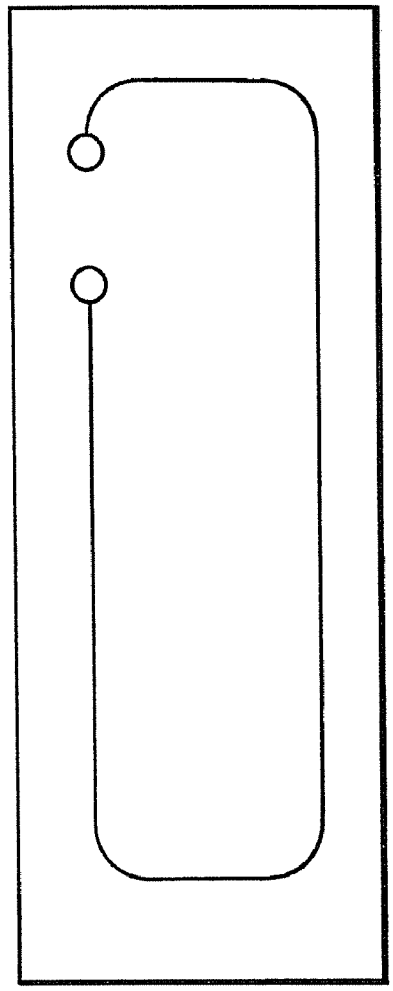

FIG. 19*d* illustrates a generally rectangular form with radiused corners, so that the rod bends monotonically from one end to the opposite end through a total of 360°. The radius of curvature of the corners should typically be about 100 mm.

Figure 19E:
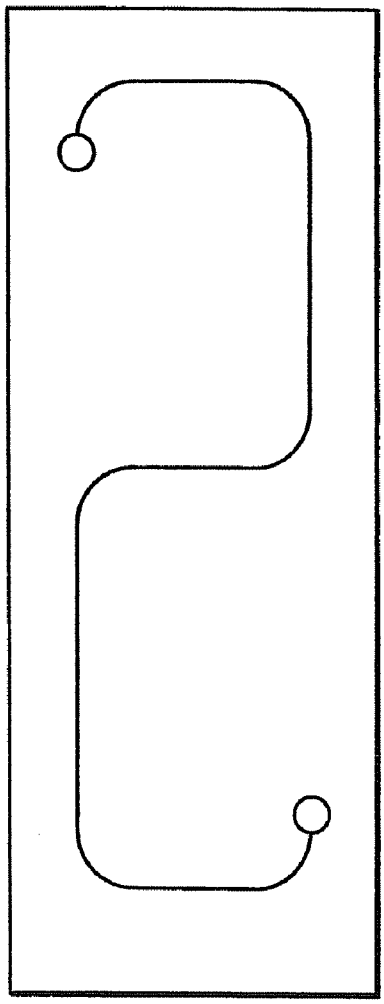
Figure 19F:
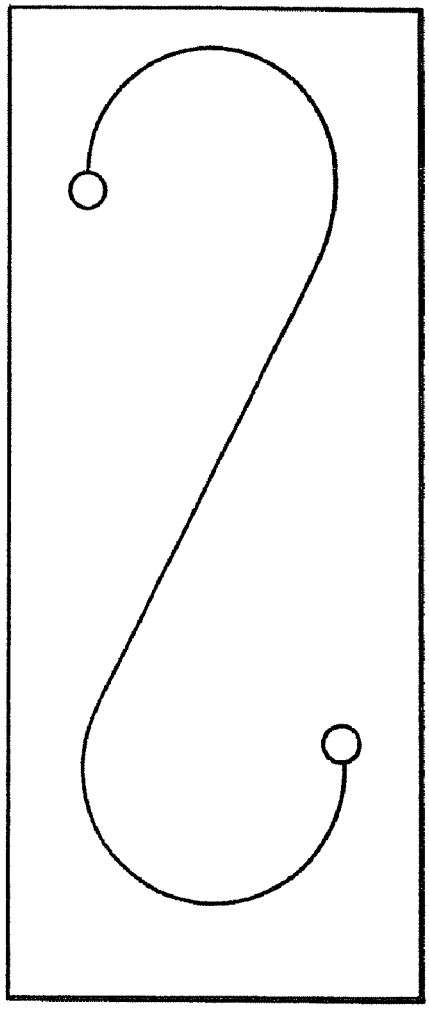

FIG. 19*e* illustrates an S-shaped rod comprising a first portion which bends through a 270° monotonically in three 90° curves interconnected by straight portions. The rod then bends 270° monotonically in the opposite direction again by three bends interconnected by straight portions. The bend radius of curvature is again about 100 mm. In FIG. 19*f* an S-shape is illustrated having a first portion bending monotonically through about 120° smoothly connected to a straight diagonal portion, and in turn smoothly connected to a further curved portion bending monotonically in the opposite direction again by about 210°.

For all the above described resonators, both spiral and other curved shapes, the transducer may be located at either end of the resonator.

Other possible excitation sources for the resonator 14 include striking sources, both active (driven) and passive (parasitic), which apply impulses producing resonant ringing vibration of the resonator 14.

Although the term resonator is used for the resonator 14 in this embodiment, the member may function more as a transmission member for the vibration energy transmitted to the member from a driven excitation source.

Embodiments of the invention may be applied also to sieves with multiple screens, for example multi layer screens with lower screens of increasing fineness for classifying materials into more than two particle sizes. Then one or more of the screens of the sieve may be fitted with the excited guide member, or the spiral or smoothly curved resonator, as described above.

It should also be understood that the generally spiral-shaped guide members or resonators in various of the examples described above need not have an inner end at the centre of a circular sieve screen.

In a further example, a so-called cascade sieve has upper and lower screens of the same mesh, with oversize from the upper screen being fed on to the lower screen to retrieve remaining fines which may not have had an opportunity to pass through the upper screen. Fines which do pass through the upper screen are collected and tunnelled through an aperture in the centre of the lower screen. In such a cascade sieve design, the lower screen can be fitted with an excited guide member or a spiral resonator having an inner end terminating outside the central aperture of the lower screen.

The excitation induced in the guide member in the embodiments of the invention described above has been referred to as one which produces a deblinding excitation in the sieve screen. Generally, secondary excitation of the sieve screen, e.g. at ultrasonic frequencies, is known to speed up the flow of fines through the screen during sieving so that the productivity of the sieve is improved. This enhanced flow through the screen may be the result of other processes than the removal of blind areas on the screen, such as the fluidisation of the material at the screen interface. It should be understood that the term deblinding used herein to describe the excitation applied to the screen is intended to encompass other processes by which the excitation enhances product flow rate through the screen compared to the rate achieved with only the basic vibratory sieve action.

In the above described examples of the invention, the guide member or the resonator is described as being secured to the sieve screen. In other embodiments, the guide member may be only in contact with the screen, e.g. pressing against the screen with sufficient pressure to enable vibrations in the guide member to be transmitted to the screen to provide the deblinding excitation. Where the embodiment provides only a resonator which does not necessarily act as a guide member, i.e. one which may be located beneath the sieve screen, the resonator again may be only in contact with the screen and not specifically secured to it.

Further, in examples of the invention which are intended primarily for sieving (or straining) liquid materials, the guide member may be spaced above the sieve screen so as to make no direct contact with the screen over at least a part of the length of the guide member. Then, provided there is sufficient depth above the sieve screen of liquid to be sieved so as to fill the gap between the guide member and the sieve screen itself, vibrations in the guide member are transmitted to the screen to provide the deblinding excitation through the liquid material. Similar transmissions may also be possible through some dry materials. In practical arrangements, the spacing between the guide member and the liquid material should not be so great or so extensive as to provide no effective control over the flow of the liquid material over the sieve screen. When the space between the guide member and the sieve screen is only a fraction of the head of liquid to be sieved which may be retained over the sieve screen, the guide member still provides effective control of the flow of the material to be sieved over the top of the sieve screen and simultaneously enables deblinding excitation (as defined above) to be transmitted to the sieve screen. When the guide member is not in contact with or secured to the sieve screen over its entire length, the guide member may be mounted directly to the sieve screen frame or sieve deck, preferably by appropriate acoustic decoupling mounts, to minimise loss to the sieve screen frame of vibration energy supplied to the guide member for use in inducing deblinding excitation of the sieve screen.

In a yet further example of the invention using a guide member on top of the sieve screen, the guide member may form a substantially closed loop, for example a circle, which may be located concentrically in a circular sieve frame for example. Then, the guide member may have multiple apertures through the guide member, for example in the manner illustrated in FIG. 11*d*, to permit material being sieved to flow outwards from within the closed loop guide member. The presence of the guide member, together with the apertures through it, have the effect of controlling the outwards flow of material to be sieved under the main vibratory action of the sieve frame and screen. In this way, the residence time of material to be sieved over the sieve screen can be increased, to improve the chances of fines reaching the sieve screen and falling through. In this way, sieving efficiency can be increased whilst at the same time ensuring good deblinding excitation of the screen.

The invention claimed is:

1. A sieve comprising:

a base;

a sieve screen frame mounted on the base;

a separator screen mounted in the frame;

a vibrator arranged to vibrate the frame relative to the base;

a resonator secured to or contacting the separator screen, wherein the resonator comprises a rod extending between spaced ends;

an ultrasonic transducer at one of said spaced ends to excite the resonator rod at a resonant frequency having a predetermined wavelength along the length of the resonator rod;

said resonator rod having at least a portion of its length which bends smoothly in a single direction of curvature through at least 90°, and the rod having a minimum radius of curvature at any point between said spaced ends which is greater than said predetermined wavelength;

and wherein said resonator rod is S-shaped, comprising a first monotonically curving portion which bends through at least 90° and is smoothly connected to a second curving portion which also bends monotonically (with curvature of opposite sign to the first curving portion) back through at least 90°.

2. A sieve in accordance with claim 1, wherein said minimum radius of curvature is greater than 50 mm.

3. A sieve in accordance with claim 1, wherein said predetermined wavelength is between 25 mm and 35 mm.

4. A sieve in accordance with claim 1, wherein said rod bends in said single direction of curvature, over at least a portion thereof, by at least 180°.

5. A sieve in accordance with claim 1, wherein the sieve further comprises a support frame beneath the sieve screen.

6. A sieve in accordance with claim 5, wherein said ultrasonic transducer comprises a transducer, resonator, and a support device, which supports the excitation source on the support frame and also acts to minimise the excitation of said support frame.

7. A sieve in accordance with claim 6, wherein an additional support device for the resonator is provided at a node and is attached to the resonator such that excitation of the support frame is minimised.

8. A sieve in accordance with claim 1, wherein the curvature of the rod varies over the length of the rod between the ends.

9. A sieve in accordance with claim 1, wherein the resonator rod comprises a straight portion smoothly connected between said first and second curving portions.

10. A sieve in accordance with claim 1, wherein the first curving portion is directly connected to said second curving portion.

11. A sieve in accordance with claim 1, wherein the first curving portion bends through 270° monotonically in three 90° curves interconnected by straight portions and the second curving portion bends 270° monotonically in the opposite direction also in three 90° bends interconnected by straight portions.

* * * * *